United States Patent [19]

Pearson

[11] 4,171,693

[45] Oct. 23, 1979

[54] FURNACE

[76] Inventor: Laverne E. Pearson, Lake City Star Route, Cadillac, Mich. 49601

[21] Appl. No.: 780,713

[22] Filed: Mar. 24, 1977

[51] Int. Cl.[2] ..... F24H 3/06

[52] U.S. Cl. ..... 126/104 R; 126/60

[58] Field of Search ..... 126/60–67, 126/108, 104 R, 307 R

[56] References Cited

U.S. PATENT DOCUMENTS

| | | | |
|---|---|---|---|
| 524,342 | 8/1894 | McCarroll | 126/60 |
| 660,371 | 10/1900 | Foley | 126/67 |
| 711,853 | 10/1902 | Hartford | 126/108 |
| 1,297,183 | 3/1919 | Kinney | 126/65 |
| 2,056,507 | 10/1936 | Douglas et al. | 126/61 |

*Primary Examiner*—William E. Wayner
*Assistant Examiner*—William E. Tapolcai, Jr.
*Attorney, Agent, or Firm*—Gifford, Chandler, VanOphem, Sheridan & Sprinkle

[57] ABSTRACT

A high efficiency furnace is provided for a forced air heating system having a furnace housing which is open at its lower end to cold air return means for the heating system and is open near its top to hot air exhaust means for the heating system. The furnace includes a burner housing contained within the furnace housing and adapted to receive and to burn a combustible fuel. A heat exchanger housing is positioned on top of the burner housing and the interiors of the burner and heat exchanger housings communicate with each other by means of a pipe. An exhaust means is provided for exhausting combustion products from the interior of the heat exchanger housing and comprises a substantially horizontal tube extending through the interior of the heat exchanger housing. The tube is open at one end to a flue outside the furnace housing and at the other end includes an opening open to the interior of the heat exchanger housing. In practice the furnace construction of the present invention achieves a high efficiency heat exchange to the air flowing through the furnace housing and around both the burner and heat exchanger housings before the combustion products are exhausted through the exhaust means and to the chimney.

8 Claims, 3 Drawing Figures

FURNACE

BACKGROUND OF THE INVENTION

I. Field of the Invention

The present invention relates generally to heating systems and, more particularly, to a high efficiency furnace construction for a forced air heating system.

II. Description of the Prior Art

There are many previously-known forced air furnaces for home use or the like. These previously-known forced air furnaces typically use natural gas or fuel oil for the heating medium. The combustion of the natural gas or fuel oil heats a plenum above the furnace while the exhaust fumes resulting from the combustion are exhausted through an appropriate flue.

A disadvantage of these previously-known heating systems is that a substantial portion of the hot combustion fumes exhaust through the flue and exteriorly of the home. The exhaustion of hot exhaust gases from the furnace, of course, results in a heat loss from the furnace and unnecessarily reduces the heating efficiency of the furnace.

Yet another disadvantage of these previously-known heating systems is that, as previously mentioned, such systems are typically restricted to the use of fuel oil or natural gas as the heating medium. The price of both natural gas and fuel oil has rapidly increased in recent years and it is expected by many that the increase in price of these fuels will continue to rapidly increase in the future. Moreover, many expect these so-called fossil fuels to become completely depleted and unavailable in the not distant future.

The reliance of these previously-known furnaces on natural gas and fuel oil presents still a further problem, namely that these fuels are not currently available to the more rural areas, not only of this nation, but of the world. Even in the rural areas where these fossil fuels are available, the cost of transporting these fuels into those areas is excessive.

While there have, of course, been previous furnaces suitable for burning wood, these have generally been quite inefficient.

SUMMARY OF THE PRESENT INVENTION

The furnace of the present invention overcomes the above-mentioned disadvantages of the previously-known furnaces by providing a high efficiency forced air furnace which utilizes solid fuels, such as wood or coal, as the fuel source.

The furnace of the present invention is provided for use in conjunction with a heating system of a home, office building, or the like having hot air ducts and cold air return ducts. The furnace of the present invention comprises a furnace housing in which the cold air return duct is coupled to the lower end of the housing while the hot air ducts are coupled to the upper end of the furnace housing. This, of course, is of conventional construction.

A burner housing is disposed within the furnace housing while a heat exchanger housing is positioned on top of the burner housing and also within the furnace housing. The burner housing and the heat exchanger are of a substantially identical configuration. The interiors of the burner and heat exchanger housing are coupled together by a pipe so that the combustion gases produced in the burner housing pass directly through the pipe and into the interior of the heat exchanger housing.

A tube extends through the interior of the heat exchanger housing and is coupled at one end to a conventional flue or chimney. An opening is also provided at the other end of the tube within the interior of the heat exchanger housing so that exhaust fumes within the heat exchanger housing can exit through the opening, the tube and to the flue.

In operation, a solid fuel, such as wood or coal, is burned within the burner housing so that the exhaust fumes from the combustion pass through the pipe and into the interior of the heat exchanger housing. From the interior of the heat exchanger housing, the exhaust fumes pass through the opening in the tube and exit through the tube to the furnace flue or chimney. Simultaneously, an airflow through the furnace housing, which is preferably created by a fan, contacts both the burner and the heat exchanger housings to thereby heat the air as it passes through the furnace housing.

The exhaust fumes from the burner housing swirl around in the heat exchanger housing before finding the opening in the tube and this increases the efficiency of heat transfer to the airflow through the furnace housing. Moreover, the exhaust gases which pass through the tube and to the flue are relatively cool due to this high efficiency of heat transfer.

BRIEF DESCRIPTION OF THE DRAWINGS

A better understanding of the present invention will be had upon reference to the following detailed description when read in conjunction with the accompanying drawing wherein like reference characters refer to like parts throughout the several views and in which.

DETAILED DESCRIPTION OF THE PRESENT INVENTION

Figure 1:
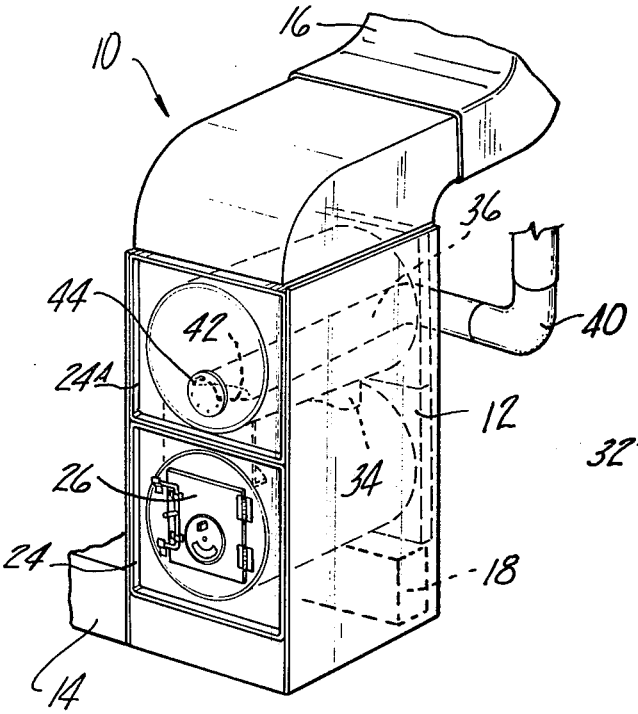
FIG. 1 is a perspective view illustrating the furnace of the present invention.
Figure 3:
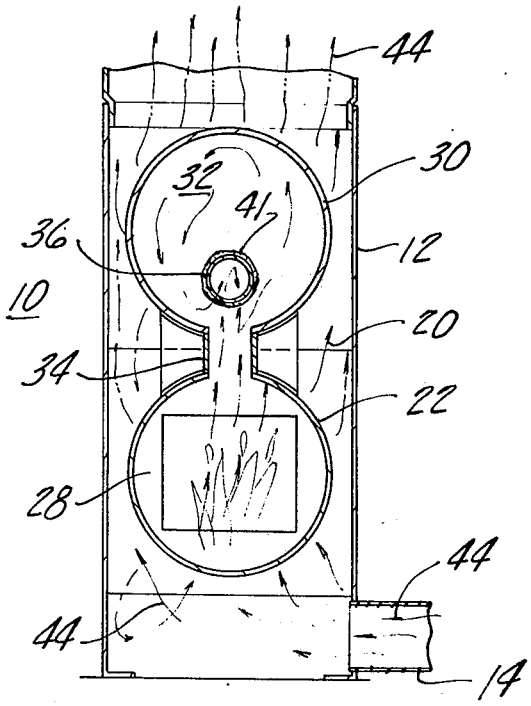
FIG. 3 is a sectional view of the furnace of the present invention taken substantially along line 3—3 in FIG. 2.

With reference first to FIGS. 1 and 3, the furnace 10 of the present invention is thereshown and includes a furnace housing 12 having an interior 20 which is vertically elongated and generally rectangular in cross-sectional shape. The furnace 10 of the present invention is adapted for connection to the heating system (not shown) of a home, office building, or the like. Such home heating systems typically include a hot air ductwork system for supplying heat to the home and a cold air return ductwork system which returns relatively cool air to the furnace in order to be reheated.

The cold air return system is coupled by a duct 14 to the bottom of the furnace housing 12 while the hot air system is connected by a duct 16 to the upper end of the furnace housing 12. Fan means 18, illustrated only diagrammatically in FIG. 1, within the furnace housing 12 forces air through the duct 16 and into the hot air system of the house. This, of course, simultaneously draws cold air into and through the cold air return system and duct 14 and into the interior 20 of the furnace housing 12. The structure of the furnace 10 which has thus far been described is of substantially conventional construction and well known to those skilled in the art to which it pertains.

Figure 2:
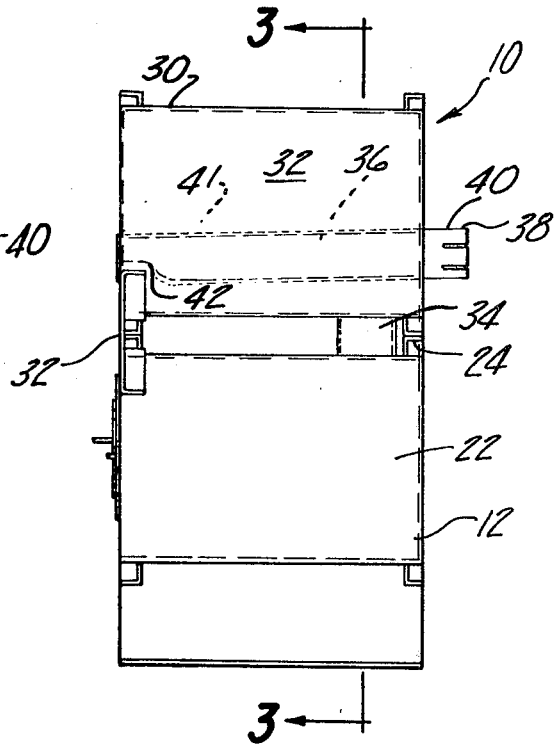
FIG. 2 is a side plan view illustrating the furnace of the present invention and with parts removed for clarity.

With reference now to FIGS. 1-3, a tubular and cylindrical burner housing 22 having an interior 28 is supported by collars 24 which are mounted to the interior of the housing 12. The housing 12 is removed from the front of the furnace 10 in FIG. 1 to more clearly illustrate the construction of the collar 24. The longitudinal axis of the burner housing 22 is substantially horizontal as best seen in FIG 2. The burner housing 22 extends across the furnace housing 12 and includes a door 26 at one axial end to permit access into the interior 28 of the burner housing 22. In addition, as best shown in FIG. 3, while the burner housing 22 extends longitudinally across the furnace housing 12 into the collars 24, it is spaced laterally inwardly from the sides of the furnace housing 12 to permit an airflow up through the interior 20 of the furnace housing 12 and around the burner housing 22.

A tubular cylindrical heat exchanger housing 30 having an interior 32 is secured vertically above the burner housing 22 by collar members 24A which rest upon the collars 24. The heat exchanger housing 30 is substantially identical in shape to the burner housing 22 so that the heat exchanger housing 30 also extends longitudinally across the furnace housing 12 into the collar members 24A, but is laterally spaced inwardly from the sides of the furnace housing 12. In addition, the interior 28 of the burner housing 22 is coupled to the interior 32 of the heat exchanger housing 30 by means of a vertical pipe 34. The pipe 34 also provides additional support between the burner housing 22 and the heat exchanger housing 30.

The collars 24 and 24A preferably extend several inches from the front and from the back of the furnace 10 and are preferably open at their top and their bottom to permit airflow between the ends of the housings 22 and 30 and the interior of the housing 12.

An exhaust tube 36 extends longitudinally and substantially horizontally through and near the base of the heat exchanger housing 30. The tube 36 extends exteriorly at one end 38 of the heat exchanger housing 30 and is coupled by conduits 40 to a flue or chimney (not shown) in the conventional fashion. An access plate 43 covers the other end of the tube 36 and permits access to the interior of the tube 36 for cleaning and the like. In addition an opening 42 near this latter end of the tube 36 and preferably on the lower side thereof establishes fluid communication between the interior 32 of the heat exchanger housing 30 and the interior of the tube 36. The opening 42 is disposed at the end of the exhaust tube 36 opposite the vertical pipe 34.

In operation, the door 26 to the burner housing 22 is opened and solid fuel, preferably wood, is placed within the interior 28 of the burner housing 22 and ignited which heats the burner housing 22. The hot fumes resulting from the combustion of the solid fuel pass through the tube 34 into the interior 32 of the heat exchanger housing 30. However, due to the location of the opening 42 in the tube 36, the hot combustion gases circulate and swirl around in the heat exchanger housing 30 before passing into the tube and this increases the efficiency of heat transfer from the hot gases to the heat exchanger housing 30. The opening 42 is disposed in the lower portion of the heat exchanger housing 30 so that only the cooler fumes escape through the opening 42 and out the flue 40. Positioning the opening 42 at the end of the tube 36 opposite the pipe 34 also insures circulation of the hot fumes in the heat exchanger housing 30.

Simultaneously, as shown in FIG. 3, the fan means 18 draws air up through the furnace housing 12, as indicated by arrows 44, from the cold air return duct 14. The airflow through the furnace housing 12 contacts or impinges upon both the burner housing 22 and heat exchanger housing 30 which heats the air in the obvious fashion before the air is forced into the hot air system for the home.

The combustion fumes within the interior 32 of the heat exchanger housing 30 cool after transferring their heat to the airflow through the furnace housing 12. As the exhaust fumes cool, they fall to the lower portion of the heat exchanger housing 30 and pass through the restricted opening 42, the tube 36, and through the flue (not shown). However, due to the opening 42, the exhaust fumes exhausting from the tube 36 into the flue are relatively cool due to the swirling action of the hot gases in the interior 32 of the heat exchanger housing 30 and the resultant high efficiency heat transfer from the combustion gases to the heat exchanger housing 30.

As clearly shown in the drawing in FIG. 2, the tube 36 is preferably tilted slightly forwardly from the horizontal so that any solid or liquid particles remaining in the exhaust gases and which are deposited in the interior of the tube 36 will eventually gravitate toward the opening 42 to facilitate their removal from the interior of the tube 36. The tube 36 is preferably covered with a heat resistant insulating material such as asbestos or the like and which can best be seen at 41 in FIGS. 2 and 3.

The furnace 10 of the present invention, thus, achieves several advantages over the previously-known furnaces for forced air heating systems. One such advantage is that the furnace 10 of the present invention enjoys a high efficiency heat transfer to the heating system airflow which has been previously described.

Another prime advantage of the furnace 10 of the present invention is that solid fuels, such as wood, coal, and the like, can be used rather than the previously-known natural gas and fuel oil fuels. The back pressures generated by the manner of exhausting the combustion products produces a wood or coal fire that will last unattended for substantial lengths of time.

A further advantage achieved by the present invention is that the relatively simple construction of the furnace and the substantially identical construction of the burner housing 22 and the heat exchanger 30 provide a furnace capable of being economically and massed produced.

While is has been preferred to illustrate the tube 36 as being substantially horizontal it should be understood that the tube 36 could extend vertically as well with the open bottom positioned in the lower portion of the heat exchanger 30.

Having described my invention, further modifications and improvements will become apparent to those skilled in the art to which it pertains without deviating from the spirit of the invention as defined by the scope of the appended claims.

I claim:

1. A furnace comprising:

a furnace housing having air inlet means at its bottom and air outlet means at its top;

a burner housing contained within said furnace housing, said burner housing adapted to burn a combustible fuel;

a heat exchanger housing positioned on top of said burner housing;

fluid passage means for connecting the lower portion of the interior of said burner housing with the interior of said heat exchanger housing, said fluid passage means being connected adjacent one end of the burner housing and adjacent one end of the heat exchanger housing; and flue means for exhausting the interior of said heat exchanger housing wherein said flue means comprises a substantially horizontal tube extending through the interior of said heat exchanger housing near but spaced away from the base of the heat exchanger housing, said tube being open at one end to chimney means and having its other end connected to the other end of the heat exchanger housing and having an opening near its other end and on the lower side thereof to the interior of said heat exchanger housing, said last mentioned opening of the tube being closely adjacent the other end of the interior of the heat exchanger housing whereby the exhaust gases entering the interior of the heat exchanger housing must pass through the interior and substantially along the entire length of the heat exchanger housing to enter into the opening of the tube so that only relatively cool gases are exhausted through the tube.

2. The invention as defined in claim 1 wherein said burner housing is substantially cylindrical in cross-sectional shape with its axis positioned horizontally in said furnace housing.

3. The invention as defined in claim 2 wherein said heat exchanger housing is substantially identical to said burner housing and wherein the axis of said heat exchanger housing is parallel to the axis of said burner housing.

4. The invention as defined in claim 1 and including door means at one axial end of said burner housing.

5. The invention as defined in claim 3 wherein said burner housing and said heat exchanger housing extend substantially entirely longitudinally across said furnace housing and wherein said burner housing and said heat exchanger housing are spaced laterally inwardly from said furnace housing.

6. The invention as defined in claim 1 wherein said combustible fuel is wood.

7. The invention as defined in claim 1 and in which said tube is inclined downwardly from the horizontal in a direction toward the front of said furnace.

8. The invention as defined in claim 1 and in which said tube is inclined downwardly from the horizontal in a direction toward said opening at said other end of said tube.

* * * * *